US008826691B2

(12) United States Patent
Yoon et al.

(10) Patent No.: US 8,826,691 B2
(45) Date of Patent: Sep. 9, 2014

(54) AIR CONDITIONER

(75) Inventors: Pil Hyun Yoon, Seoul (KR); Sai Kee Oh, Anyang-si (KR)

(73) Assignee: LG Electronics Inc., Seoul (KR)

( * ) Notice: Subject to any disclaimer, the term of this patent is extended or adjusted under 35 U.S.C. 154(b) by 671 days.

(21) Appl. No.: 12/010,874

(22) Filed: Jan. 30, 2008

(65) Prior Publication Data

US 2009/0107169 A1 Apr. 30, 2009

(30) Foreign Application Priority Data

Oct. 25, 2007 (KR) ..... 10-2007-0107561

(51) Int. Cl.

| | |
|---|---|
| ***F25B 43/02*** | (2006.01) |
| ***F25B 41/00*** | (2006.01) |
| ***F25B 1/10*** | (2006.01) |
| ***F25B 31/00*** | (2006.01) |

(52) U.S. Cl.

CPC ..... *F25B 31/004* (2013.01); *F25B 2400/04* (2013.01); *F25B 2400/075* (2013.01); *F25B 43/02* (2013.01); *F25B 2341/0016* (2013.01)

USPC ..... 62/468; 62/196.1; 62/470; 62/510

(58) Field of Classification Search

USPC ..... 62/468, 470, 510, 509, 196.1, 196.2, 62/196.3

See application file for complete search history.

(56) References Cited

U.S. PATENT DOCUMENTS

| | | | | | |
|---|---|---|---|---|---|
| 3,238,738 | A | * | 3/1966 | Webber | 62/196.2 |
| 4,586,351 | A | * | 5/1986 | Igarashi et al. | 62/510 |
| 4,918,942 | A | * | 4/1990 | Jaster | 62/335 |
| 5,236,311 | A | * | 8/1993 | Lindstrom | 62/510 |
| 5,396,779 | A | * | 3/1995 | Voss | 62/196.2 |
| 5,586,450 | A | * | 12/1996 | Tollar et al. | 62/468 |
| 2006/0101845 | A1 | * | 5/2006 | Jeong et al. | 62/468 |
| 2010/0115975 | A1 | * | 5/2010 | Mitra et al. | 62/196.1 |

FOREIGN PATENT DOCUMENTS

| | | | |
|---|---|---|---|
| EP | 0715133 | A1 | 6/1996 |
| JP | 2002-327975 | A | 11/2002 |
| JP | 2007-009922 | A | 1/2007 |
| KR | 10-2002-0053451 | | 7/2002 |
| KR | 1020020053451 | A | 7/2002 |
| KR | 10-2006-0039344 | | 5/2006 |
| KR | 10-2006-0055830 | | 5/2006 |
| KR | 1020060039344 | A | 5/2006 |
| KR | 1020060055830 | A | 5/2006 |

* cited by examiner

*Primary Examiner* — Mohammad M Ali
*Assistant Examiner* — Daniel C Comings
(74) *Attorney, Agent, or Firm* — McKenna Long & Aldridge LLP

(57) ABSTRACT

An air conditioner includes at least one compressor, an outlet pipe, an inlet pipe, and at least one bypass pipe. Oil and/or refrigerant discharged from the at least one compressor flows through the outlet pipe. The inlet pipe receives the oil and/or refrigerant flown through the outlet pipe and allows the oil and/or refrigerant to flow to the at least one compressor. The at least one bypass pipe is connected to the at least one compressor and allow bypass flows of the oil and/or refrigerant from the at least one compressor to the outlet pipe.

17 Claims, 6 Drawing Sheets

AIR CONDITIONER

CROSS-REFERENCE TO RELATED APPLICATIONS

The present application claims priority under 35 U.S.C. 119 and 35 U.S.C. 365 to Korean Patent Application No. 10-2007-0107561 (filed on Oct. 25, 2007), which is hereby incorporated by reference in its entirety.

BACKGROUND

Embodiments relate to an air conditioner.

An air conditioner is a device for controlling the temperature or humidity of air using a cycle of compression, condensation, expansion, and evaporation.

In some recent air conditioners, a plurality of indoor units is connected to one or more outdoor units. In this case, the number of compressors included in the outdoor units may vary according to the capacities of the indoor units. For instance, a plurality of compressors can be included in one outdoor unit.

Oil separators can be coupled to outlets of the compressors, respectively. The oil separators collect oil and supply the collected oil to inlets of the compressors through oil collection pipes.

Oil collected from one compressor is supplied to the same compressor and is not supplied to the other compressors. Thus, the compressors can have unbalanced oil level, and components of a compressor having insufficient oil can lead to mechanical abrasion.

SUMMARY

Embodiments provide an air conditioner in which surplus oil can be discharged from a compressor.

Embodiments provide an air conditioner in which oil levels of compressors are balanced so that the compressors can be prevented from being damaged due to insufficient oil.

In one embodiment, an air conditioner includes: at least one compressor; an outlet pipe through which oil and/or refrigerant discharged from the at least one compressor flows; an inlet pipe receiving the oil and/or refrigerant flown through the outlet pipe and allowing the oil and/or refrigerant to flow to the at least one compressor; and at least one bypass pipe connected to the at least one compressor and allowing bypass flows of the oil and/or refrigerant from the at least one compressor to the outlet pipe.

In another embodiment, an air conditioner includes: a plurality of compressors; a plurality of branch outlet pipes through which a fluid discharged from the compressors flows; pressure reduction parts respectively disposed at the branch outlet pipes for reducing a pressure of a fluid discharged from the compressors; and bypass pipes connected from the compressors to the pressure reduction parts for allowing bypass flows of a fluid from the compressors to the branch outlet pipes.

In a further embodiment, an air conditioner includes: a plurality of compressors; a plurality of branch outlet pipes connected to the compressors for receiving flows of the fluid discharged from the compressors; at least one oil separator separating oil from a fluid flowing through the branch outlet pipe units; and a plurality of bypass pipes connected to the compressors for receiving bypass flows of the fluid discharged from the compressors and connected to an inlet or outlet of the oil separator.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
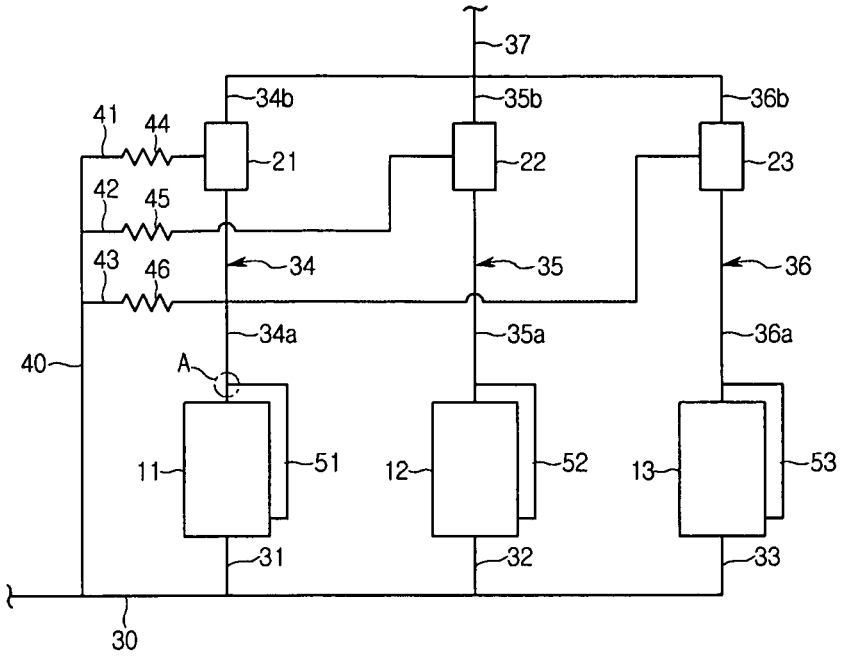
FIG. 1 is a partial refrigerant cycle diagram of an air conditioner according to a first embodiment.

FIG. 1 is a partial refrigerant cycle diagram of an air conditioner according to a first embodiment.

Referring to FIG. 1, the air conditioner of the current embodiment includes a plurality of compressors such as first, second, and third compressors 11, 12, and 13 that are disposed in parallel. Although three compressors are shown in FIG. 1, the number of compressors can vary.

The capacities of the compressors 11, 12, and 13 can be different. Furthermore, various types of compressors can be used for the compressors 11, 12, and 13. For example, an inverter compressor having a variable rotation speed or a constant speed compressor can be used.

An inlet pipe unit is connected to the compressors 11, 12, and 13 to supply refrigerant from an evaporator (not shown) to the compressors 11, 12, and 13. The inlet pipe unit may include a common inlet pipe 30 and a plurality of branch inlet pipes 31, 32, and 33. The branch inlet pipes 31, 32, and 33 branch off from the common inlet pipe 30 and are connected to the respective compressors 11, 12, and 13.

Refrigerant discharged from the evaporator is introduced into the common inlet pipe 30, is distributed to the branch inlet pipes 31, 32, and 33, and is then supplied to the compressors 11, 12, and 13.

An outlet pipe unit is connected to the compressors 11, 12, and 13 for carrying the refrigerant discharged from the compressors 11, 12, and 13. The outlet pipe unit may include a plurality of branch outlet pipes 34, 35, and 36, and a common outlet pipe 37. The branch outlet pipes 34, 35, and 36 are connected to the respective compressors 11, 12, and 13. The branch outlet pipes 34, 35, and 36 are all connected to the common outlet pipe 37 where streams of refrigerant from the compressors 11, 12, and 13 combine.

Therefore, streams of refrigerant discharged from the compressors 11, 12, and 13 flow along the branch outlet pipes 34, 35, and 36, and then gather at the common outlet pipe 37. Thereafter, the gathered refrigerant flows to a condenser (not shown).

Oil separators 21, 22, and 23 are disposed at the branch outlet pipes 34, 35, and 36 to separate oil from streams of refrigerant discharged from the compressors 11, 12, and 13.

The branch outlet pipes 34, 35, and 36 include first pipes 34*a*, 35*a*, and 36*a* connected between the compressors 11, 12, and 13 and the Oil separators 21, 22, and 23. The branch outlet pipes 34, 35, and 36 further include second pipes 34*b*, 35*b*, and 36*b* connected between the common outlet pipe 37 and the oil separators 21, 22, and 23.

An oil collection unit is connected to the oil separators 21, 22, and 23 to supply the oil separated by the oil separators 21, 22, and 23 back to the compressors 11, 12, and 13.

The oil collection unit may include branch oil collection pipes 41, 42, and 43 and a common oil collection pipe 40. The branch oil collection pipes 41, 42, and 43 are connected to the oil separators 21, 22, and 23, respectively. The common oil collection pipe 40 is connected between the common inlet pipe 30 and the branch oil collection pipes 41, 42, and 43 for combining streams of oil coming from the branch oil collection pipes 41, 42, and 43 and supplying the combined oil to the common inlet pipe 30.

Therefore, oil separated by the oil separators 21, 22, and 23 flows through the branch oil collection pipes 41, 42, and 43, and streams of the oil gather at the common oil collection pipe 40. Then, the gathered oil is supplied to the common inlet pipe 30. Capillaries 44, 45, and 46 may be disposed at the respective branch oil collection pipes 41, 42, and 43 for reducing the pressure of oil flowing through the branch oil collection pipes 41, 42, and 43.

Ends of first to third bypass pipes 51, 52, and 53 are connected to the compressors 11, 12, and 13 for discharging oil from the compressors 11, 12, and 13 when the compressors 11, 12, and 13 contain excessive oil. The other ends of the first to third bypass pipes 51, 52, and 53 are connected to the first pipes 34*a*, 35*a*, and 36*a*.

The bypass pipes 51, 52, and 53 are usually connected to the compressors 11, 12, and 13 at heights higher than normal oil levels of the compressors 11, 12, and 13. The normal oil levels of the compressors 11, 12, and 13 may vary according to the capacities of the compressors 11, 12, and 13. Therefore, the bypass pipes 51, 52, and 53 may be connected to the compressors 11, 12, and 13 at different heights.

Compressors can be low-pressure compressors or high-pressure compressors. In this embodiment, using high-pressure compressors for the compressors 11, 12, and 13 are desirable. Oil can be discharged from the compressors 11, 12, and 13 through the bypass pipes 51, 52, and 53 to outlets of the compressors 11, 12, and 13.

When the compressors 11, 12, and 13 are high-pressure type compressors, the pressure of oil stored in the compressors 11, 12, and 13 can be high. Thus, the oil may be discharged from the compressors 11, 12, and 13 through the bypass pipes 51, 52, and 53.

Figure 2:
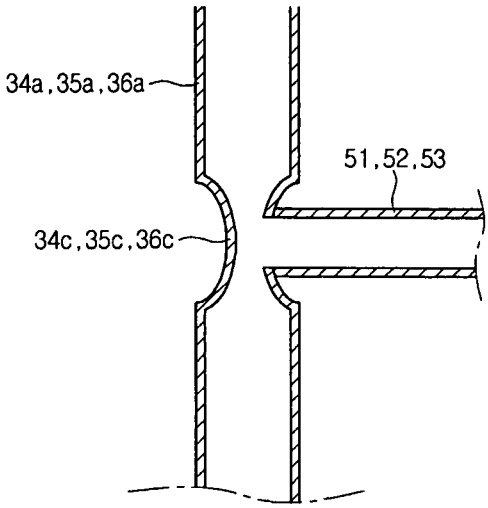
FIG. 2 is an enlarged view of portion A of FIG. 1.

FIG. 2 is an enlarged view of portion A of FIG. 1.

Referring to FIG. 2, pressure reduction parts 34*c*, 35*c*, and 36*c* are formed at the first pipes 34*a*, 35*a*, and 36*a* for reducing the pressure of the first pipes 34*a*, 35*a*, and 36*a*. The bypass pipes 51, 52, and 53 are connected to the pressure reduction parts 34*c*, 35*c*, and 36*c*.

In detail, the pressure at the outlets of the compressors 11, 12, and 13 is approximately the same as the pressure inside the bypass pipes 51, 52, and 53. Therefore, the pressure reduction parts 34*c*, 35*c*, and 36*c* are formed at the first pipes 34*a*, 35*a*, and 36*a* to allow oil to smoothly flow from the bypass pipes 51, 52, and 53 to the first pipes 34*a*, 35*a*, and 36*a*.

The pressure reduction parts 34*c*, 35*c*, and 36*c* may be formed by partially reducing the cross sectional areas of the first pipes 34*a*, 35*a*, and 36*a*. That is, the cross sectional areas of the pressure reduction parts 34*c*, 35*c*, and 36*c* are smaller than those of the first pipes 34*a*, 35*a*, and 36*a*.

In this case, streams of the refrigerant increases in velocity at the pressure reduction parts 34*c*, 35*c*, and 36*c* but reduces in pressure at the pressure reduction parts 34*c*, 35*c*, and 36*c*. Thus, the pressures of the streams of the refrigerant become lower than the pressures of streams of oil of the bypass pipes 51, 52, and 53 so that the oil can smoothly flow from the bypass pipes 51, 52, and 53 to the first pipes 34*a*, 35*a*, and 36*a*.

In this embodiment, the pressure reduction parts 34*c*, 35*c*, and 36*c* are formed by partially reducing the cross sectional areas of the first pipes 34*a*, 35*a*, and 36*a*. However, other structures may be used for forming the pressure reduction parts 34*c*, 35*c*, and 36*c*.

An exemplary operation of the air conditioner will now be described.

Figure 3:
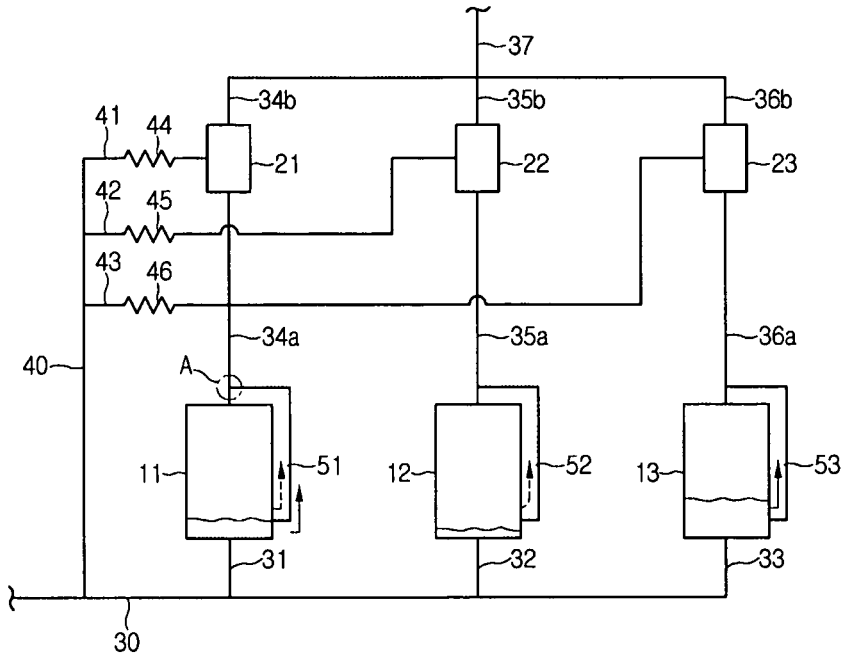
FIG. 3 is a partial refrigerant cycle diagram for illustrating an operation of the air conditioner depicted in FIG. 1.

FIG. 3 is a partial refrigerant cycle diagram for illustrating an operation of the air conditioner depicted in FIG. 1.

For example, referring to FIG. 3, the oil level of the first compressor 11 is normal, the oil level of the second compressor 12 is low, and the oil level of the third compressor 13 is high.

When the compressors 11, 12, and 13 operate, refrigerant is introduced into the compressors 11, 12, and 13 for compression. Then, the refrigerant is discharged from the compressors 11, 12, and 13 to the branch outlet pipes 34, 35, and 36, and may include oil.

For instance, since the oil level of the first compressor 11 is approximately the same height at which the first bypass pipe 51 is connected to the first compressor 11, the refrigerant is discharged from the first compressor 11 to the first bypass pipe 51 together with oil.

Since the oil level of the second compressor 12 is lower than a height at which the second bypass pipe 52 is connected to the second compressor 12, only refrigerant is discharged from the second compressor 12 to the second bypass pipe 52 (refer to a dashed line in FIG. 3).

Since the oil level of the third compressor 13 is higher than a height at which the third bypass pipe 53 is connected to the third compressor 13, only oil is discharged from the third compressor 13 to the third bypass pipe 53 (refer to a solid line in FIG. 3).

Then, the refrigerant and/or oil flow from the bypass pipes 51, 52, and 53 to the first pipes 34*a*, 35*a*, and 36*a* where they combine with the refrigerant and/or oil directly discharged from the compressors 11, 12, and 13 to the first pipes 34*a*, 35*a*, and 36*a*. Thereafter, the refrigerant and/or oil flow to the oil separators 21, 22, and 23.

Here, since the oil filled in the third compressor 13 is discharged from the third compressor 13 to the third bypass pipe 53, the oil level of the third compressor 13 decreases, and after the oil level of the third compressor 13 decreases to a level below the height at which the third bypass pipe 53 is connected to the third compressor 13, no more oil is discharged from the third compressor 13 to the third bypass pipe 53. In this case, only the compressed refrigerant is discharged from the third compressor 13 to the third bypass pipe 53.

The oil separators 21, 22, and 23 separate the oil from the refrigerant. The separated oil is discharged from the oil separators 21, 22, and 23 to the branch oil collection pipes 41, 42, and 43. However, some oil not separated from the refrigerant at the oil separators 21, 22, and 23 may be discharged from the oil separators 21, 22, and 23 to the common outlet pipe 37 together with the refrigerant.

While flowing along the branch oil collection pipes 41, 42, and 43, the streams of oil reduce in pressure and temperature at the capillaries 44, 45, and 46. Then, the streams of the oil gather at the common oil collection pipe 40. Thereafter, the oil flows to the common inlet pipe 30 where the oil is distributed to the branch inlet pipes 31, 32, and 33 together with refrigerant.

Here, the amounts of the refrigerant and the oil distributed from the common inlet pipe 30 to the branch inlet pipes 31, 32, and 33 are usually proportional to the capacities of the respective compressors 11, 12, and 13.

According to the embodiment of FIG. 3, when one of the compressors 11, 12, and 13 is filled with surplus oil (for example, the third compressor 13), oil is discharged from the third compressor 13 and eventually flow to the common inlet pipe 30 through the third bypass pipe 53. Then, the oil is distributed from the common inlet pipe 30 to the respective compressors 11, 12, and 13 so the oil levels of the compressors 11, 12, and 13 can be or will eventually be balanced.

After oil is separated from the refrigerant at the respective oil separators 21, 22, and 23, the streams of oil flow along the branch oil collection pipes 41, 42, and 43, and are combined at the common oil collection pipe 40. Thereafter, the oil is distributed to the respective compressors 11, 12, and 13. Therefore, when one of the compressors 11, 12, and 13 is filled with insufficient oil (for example, the second compressor 12), the second compressor 12 may be supplied with oil from the other compressors. In this way, the oil levels of the compressors 11, 12, and 13 may be balanced.

When one of the compressors 11, 12, and 13 has a lower capacity than the others (for example, the second compressor 12), the oil separating rate of the oil separator 22 may be low compared with those of the other oil separators 21 and 23. However, even in this case, oil separated by the other oil separators 21 and 23 may be supplied to the second compressor 12 from the common oil collection pipe 40 through the common inlet pipe 30 so that the oil level of the second compressor 12 may be properly maintained.

Figure 4:
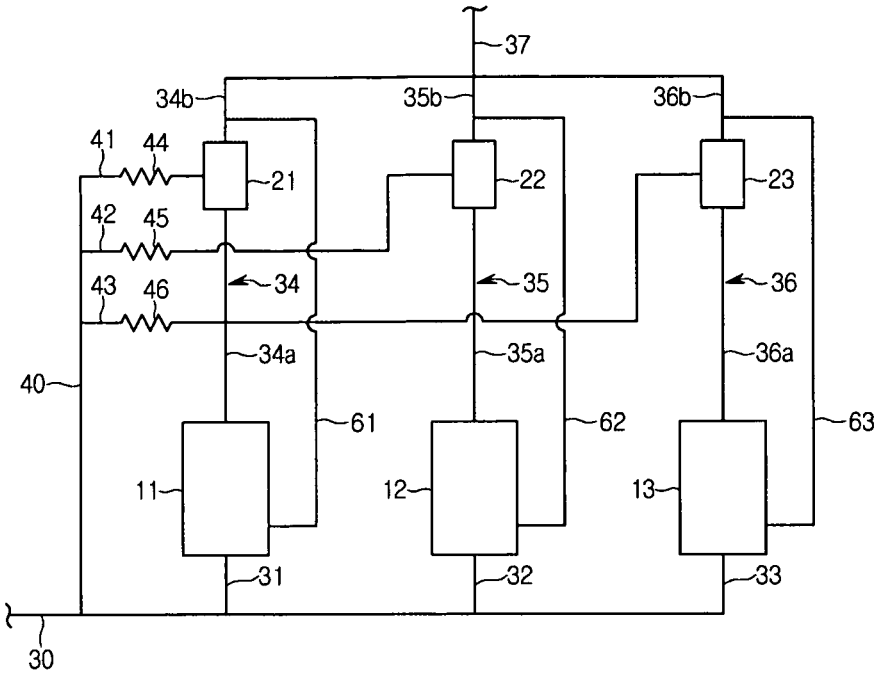
FIG. 4 is a partial refrigerant cycle diagram of an air conditioner according to a second embodiment.

FIG. 4 is a partial refrigerant cycle diagram of an air conditioner according to a second embodiment.

The air conditioner of the second embodiment may have the same or similar structure as the air conditioner of the first embodiment except for oil and/or refrigerant discharging locations of the bypass pipes. In the following description of the second embodiment, only the difference will be explained, and the same or similar structure will not be described.

In the embodiment of FIG. 4, ends of first to third bypass pipes 61, 62, and 63 are connected to compressors 11, 12, and 13, and the other ends of the first to third bypass pipes 61, 62, and 63 are connected to second pipes 34*b*, 35*b*, and 36*b* that are connected between oil separators 21, 22, and 23 and a common outlet pipe 37. Pressure reduction parts are formed at the second pipes 34*b*, 35*b*, and 36*b*.

In this case, oil discharged from the compressors 11, 12, and 13, and to the second pipes 34*b*, 35*b*, and 36*b* through the bypass pipes 61, 62, and 63 joins refrigerant discharged from the compressors 11, 12, and 13, and then the oil and/or refrigerant flows back to a common inlet pipe 30 through an condenser (not shown), an evaporator (not shown), and an expansion unit (not shown). Thereafter, the oil and/or refrigerant are distributed from the common inlet pipe 30 to the respective compressors 11, 12, and 13.

In this embodiment, the bypass pipes 61, 62, and 63 are connected to the second pipes 34*b*, 35*b*, and 36*b*. However, the bypass pipes 61, 62, and 63 can be connected to the common outlet pipe 37. In this case, as many pressure reduction parts as the number of the bypass pipes 61, 62, and 63 may be formed at the common outlet pipe 37, or only one pressure reduction part may be formed at the common outlet pipe 37 and connected to the respective bypass pipes 61, 62, and 63.

Figure 5:
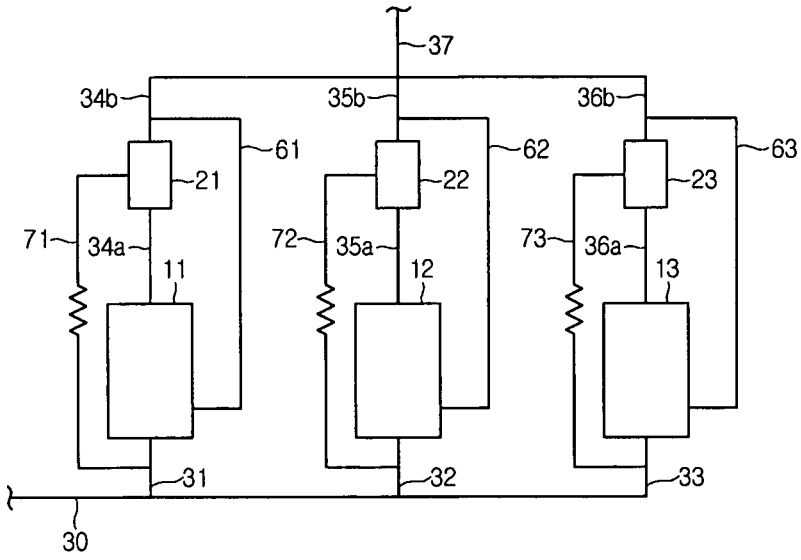
FIG. 5 is a partial refrigerant cycle diagram of an air conditioner according to a third embodiment.

FIG. 5 is a partial refrigerant cycle diagram of an air conditioner according to a third embodiment.

The air conditioner of the third embodiment may have the same or similar structure as the air conditioner of the second embodiment except for the structure of branch oil collection pipes. In the following description of the third embodiment, only the difference will be explained, and the same or similar structure will not be described.

Referring to FIG. 5, ends of first to third branch oil collection pipes 71, 72, and 73 are connected to compressors 11, 12, and 13, and the other ends of the first to third branch oil collection pipes 71, 72, and 73 are connected to branch inlet pipes 31, 32, and 33. Therefore, oil separated at oil separators 21, 22, and 23 may be directed back to the original compressors 11, 12, and 13.

Surplus oil discharged from the compressors 11, 12, and 13 flow through bypass pipes 61, 62, and 63. The discharged oil flows back to a common inlet pipe 30 through a condenser (not shown), an expansion unit (not shown), and an evaporator (not shown). Thereafter, the oil is distributed from the common inlet pipe 30 to the respective compressors 11, 12, and 13.

Figure 6:
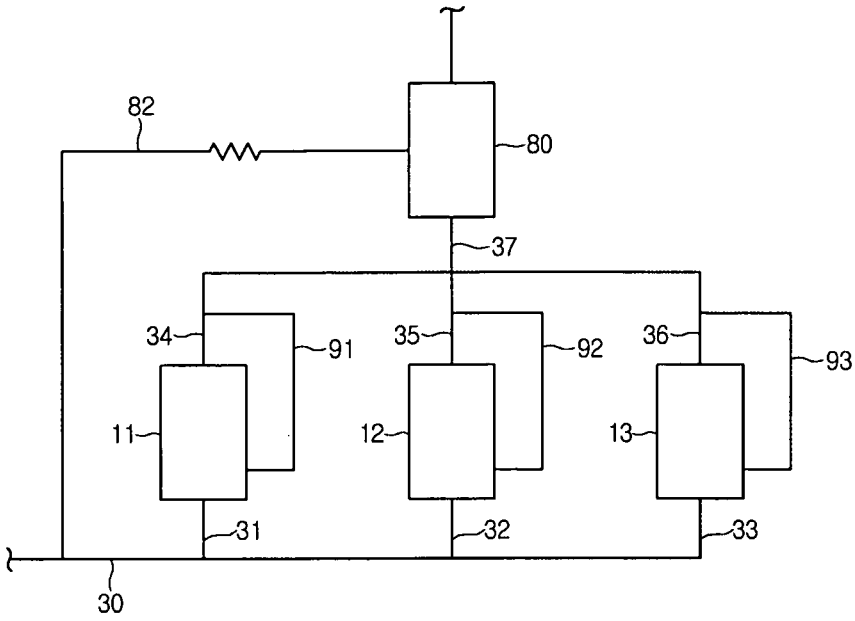
FIG. 6 is a partial refrigerant cycle diagram of an air conditioner according to a fourth embodiment.

FIG. 6 is a partial refrigerant cycle diagram of an air conditioner according to a fourth embodiment.

The air conditioner of the fourth embodiment may have the same or similar structure as the air conditioner of the first embodiment except for the structure of an oil separator. In the following description of the fourth embodiment, only the difference will be explained, and the same or similar structure will not be described.

Referring to FIG. 6, only one oil separator 80 is disposed at a common outlet pipe 37 at which streams of refrigerant from branch outlet pipes 34, 35, and 36 are gathered. Ends of bypass pipes 91, 92, and 93 are connected to compressors 11, 12, and 13, and the other ends of the bypass pipes 91, 92, and 93 are connected to the branch outlet pipes 34, 35, and 36, respectively.

An oil collection pipe 82 is connected between the oil separator 80 and a common inlet pipe 30 for allowing oil separated at the oil separator 80 to flow to the common inlet pipe 30.

Therefore, oil may be discharged from the compressors 11, 12, and 13 to the branch outlet pipes 34, 35, and 36 through the bypass pipes 91, 92, and 93, and streams of the oil may flow from the branch outlet pipes 34, 35, and 36 to the oil separator 80 through the common outlet pipe 37.

Then, the oil introduced into the oil separator 80 flows through the oil collection pipe 82 and is directed to the common inlet pipe 30. Thereafter, the oil is distributed back to the compressors 11, 12, and 13 from the common inlet pipe 30.

According to the embodiments, when one of the compressors of the air conditioner has excessive oil, some of the excessive oil is discharged from the compressor through the bypass pipe connected to the compressor, and then the discharged oil is distributed to all the compressors through the common inlet pipe. Therefore, the other compressors having insufficient oil may be filled.

Furthermore, oil may be separated by the oil separators, and streams of the separated oil may gather at the common oil collection pipe. Thereafter, the oil may be distributed to the respective compressors through the branch inlet pipes. Thus, the oil levels of the compressors may be properly maintained, and insufficient oil in the compressors may be prevented.

According to the embodiments, the oil levels of the plurality of compressors of the air conditioner may be uniformly maintained, and thus the compressor having insufficient oil maybe prevented. Therefore, the air conditioner may be applied to various industrial fields.

Any reference in this specification to "one embodiment," "an embodiment," "exemplary embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of the invention. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

a plurality of compressors, each compressor having an oil storage;

an outlet pipe through which oil and/or refrigerant discharged from the plurality of compressors flows, the outlet pipe comprising a common outlet pipe and branch outlet pipes respectively connected to the plurality of compressors, and the common outlet pipe receiving flows of oil and/or refrigerant from the branch outlet pipes;

an inlet pipe receiving the oil and/or refrigerant flown through the outlet pipe and allowing the oil and/or refrigerant to flow to the plurality of compressors, the inlet pipe comprising a common inlet pipe through which refrigerant discharged from an evaporator flows, and branch inlet pipes branching off from the common inlet pipe and respectively connected to the plurality of compressors;

a plurality of bypass pipes connected to the plurality of compressors and allowing bypass flows of the oil and/or refrigerant from the plurality of compressors to the outlet pipe, the plurality of bypass pipes respectively directly connected to the plurality of compressors and the outlet pipe, the oil stored in the oil storage of each compressor being capable of discharging to the respective bypass pipe based on a position connected to the compressor, wherein the oil and/or refrigerant is discharged from the compressors to the branch outlet pipes directly are combined with the oil and/or refrigerant discharged from the compressors through the bypass pipes; and at least one oil separator separating oil from oil and refrigerant flowing through the outlet pipe, wherein the inlet pipe receives the oil separated by the oil separator and allowing the oil to flow to the plurality of compressors via the respective branch inlet pipes.

2. The air conditioner according to claim 1, further comprising a pressure reduction part disposed at the common outlet pipe or the at least one branch outlet pipe for reducing a pressure of oil and/or refrigerant discharged from at least one compressor, and the bypass flows of the oil and/or refrigerant of at least one bypass pipe flows to the pressure reduction part.

3. The air conditioner according to claim 2, wherein the pressure reduction part is formed by narrowing a portion of the common outlet pipe or the at least one branch outlet pipe.

4. The air conditioner according to claim 2, wherein the pressure reduction part is disposed at the at least one branch outlet pipe, and the plurality of bypass pipes is connected to the pressure reduction part.

5. The air conditioner according to claim 2, wherein the common outlet pipe comprises as many pressure reduction parts as the number of the bypass pipes, and the bypass pipes are connected to the pressure reduction parts, respectively.

6. The air conditioner according to claim 2, wherein the common outlet pipe comprises a single pressure reduction part, and the bypass pipes are commonly connected to the single pressure reduction part.

7. The air conditioner according to claim 1, wherein the air conditioner comprises a plurality of oil separators, and the oil separators are disposed at respective branch outlet pipes.

8. The air conditioner according to claim 7, wherein each bypass pipe is connected to an inlet or an outlet of the respective oil separator.

9. The air conditioner according to claim 2, wherein the at least one oil separator is disposed at the common outlet pipe.

10. The air conditioner according to claim 1, further comprising an oil collector to collect oil separated by the at least one oil separator is connected to the common inlet pipe.

11. The air conditioner according to claim 10, wherein the air conditioner comprises as many oil separators as the number of the compressors, and the oil collector comprises branch oil collection pipes respectively connected to the oil separators, and a common oil collection pipe receiving flows of oil from the branch oil collection pipes and connected to the common inlet pipe.

12. The air conditioner according to claim 10, wherein the air conditioner comprises as many oil separators as the number of the compressors and as many oil collectors as the number of the compressors, and the oil collectors are connected from the oil separators to the branch inlet pipes.

13. The air conditioner according to claim 10, wherein oil collector includes at least one capillary to reduce oil pressure while flowing through the oil collector.

14. An air conditioner comprising:

a plurality of compressors, each compressor having a storage;

a plurality of branch outlet pipes through which a fluid discharged from the compressors flows, the plurality of branch outlet pipes being directly connected to the plurality of compressors;

pressure reduction parts respectively disposed at the branch outlet pipes to reduce a pressure of the fluid flowing through the plurality of branch outlet pipes;

bypass pipes directly connected from the compressors to the pressure reduction parts to allow bypass flows of a fluid from the compressors to the branch outlet pipes, the fluid stored in the storage of each compressor being capable of discharging to respective bypass pipe based on a position connected to the compressor, wherein the fluid is discharged from the compressors to the branch outlet pipes directly, and/or the fluid is discharged from the compressors to the branch outlet pipes through the bypass pipes; and an inlet pipe receiving the fluid flow through the branch outlet pipes, the inlet pipe comprising a common inlet pipe and branch inlet pipes branching off from the common inlet pipe and respectively connected to the plurality of compressors, though which the fluid flows to the plurality of compressors through respective branch inlet pipes.

15. The air conditioner according to claim 14, further comprising:

oil separators respectively disposed at the branch outlet pipes to separate oil from a fluid discharged from the compressors; and an oil collection unit allowing oil separated by the oil separators to flow to inlets of the compressors.

16. The air conditioner according to claim 15, wherein the bypass pipes are connected to inlet pipes or outlet pipes of the oil separators.

17. The air conditioner according to claim 14, wherein the pressure reduction parts have a diameter smaller than that of the branch outlet pipes.

* * * * *